US005405142A

United States Patent [19]

Arad et al.

[11] Patent Number: 5,405,142

[45] Date of Patent: Apr. 11, 1995

[54] PINBALL MACHINE WITH AN INTERACTIVE THREE-DIMENSIONAL FIGURE

[75] Inventors: Avi Arad, Westport, Conn.; Melvin Kennedy, Lantana, Fla.

[73] Assignee: Toy Biz, Inc., New York, N.Y.

[21] Appl. No.: 995,505

[22] Filed: Dec. 22, 1992

[51] Int. Cl.[6] ..... A63F 7/36

[52] U.S. Cl. ..... 273/118 R; 273/118 A; 273/119 R

[58] Field of Search ..... 273/108, 118–125, 273/127 R, 129 R

[56] References Cited

U.S. PATENT DOCUMENTS

| | | | |
|---|---|---|---|
| 4,223,889 | 9/1980 | Konta | 273/121 A X |
| 4,650,190 | 3/1987 | Geiger | 273/121 A |
| 4,840,375 | 6/1989 | Lawlor et al. | 273/121 A |
| 5,123,647 | 6/1992 | Lawlor et al. | 273/121 A |
| 5,158,292 | 10/1992 | Hanchar | 273/121 A |

OTHER PUBLICATIONS

Playtime Catalog, "Reach for the Stars '92", pp. 46–49

TOMY Catalog, The Magical World of Tomy, 1991, pp. 28–29.

Advertisement, Playtime Products, Inc., "The Uncanny X-Men, Batman, Turtles" (CR & TM 1991).

Hoffman, Carol, "Here's a game that will make you flip every time you play", Smithsonian, Jan. 1993, pp. 96–103.

*Primary Examiner*—Vincent Millin

*Assistant Examiner*—Raleigh W. Chiu

*Attorney, Agent, or Firm*—Amster Rothstein & Ebenstein

[57] ABSTRACT

A pinball machine comprising a housing having provisions for translating a ball in play throughout a plurality of locations therein, including at least one rotary spinner and active bar bumper, said housing further including flippers, inactive bumpers and ball traps and channels disposed at strategic locations on a playing field, the rotary spinners and bar bumpers being operably connected to a drive system which is operated off a single drive motor and which includes an integral scoring relay which generates a scoring signal in response to a drag torque imparted on the drive system every time a ball makes contact with a rotary spinner or bar bumper, the housing further having a three dimensional figure attached to one end thereof, adapted to move at least a part thereof relative to the housing, the figure including an internal mechanism adapted to move one arm thereof in a generally up and down motion such that it randomly and periodically impacts a trigger within the housing which engages a mechanism for raising part of the housing relative to a support surface to increase the difficulty of play, the figure further including provisions for illuminating part thereof and for displaying the player's score, and an audio speaker for providing a "speaking" effect in response to different play conditions as well as generating various sound effects.

13 Claims, 17 Drawing Sheets

PINBALL MACHINE WITH AN INTERACTIVE THREE-DIMENSIONAL FIGURE

BACKGROUND OF THE INVENTION

1. Field of the Invention

The present invention is related to improvements in pinball machines, and more particularly, to a pinball machine which includes an interactive three-dimensional opponent responsive to user play, and novel improvements with respect to internal mechanisms and scoring hardware.

2. Description of the Prior Art

Pinball machines having numerous configurations are well-known in the art. In recent years, with the miniaturization of electrical and mechanical systems, pinball machines have similarly evolved; presently, there are many commercially available tabletop sized pinball machines available which incorporate the latest technological advances in audio and visual hardware and effects. Typical pinball machines have an attached, vertically disposed backboard which usually contains various scoring indicia, lights and graphics. However, none of these have an interactive, three dimensional mechanical and electrically linked robotic figure capable of: mechanically altering the play conditions, such as by raising or lowering the angle of incidence of the playing field relative to a support surface, and; communicating visually and audibly with the player.

SUMMARY OF THE INVENTION

In accordance with the present invention, there is disclosed a pinball machine with an interactive three-dimensional figure which is responsive to user play. The pinball machine is generally comprised of an integral housing and playing surface having an attached base/-leg assembly adapted to rest on a support surface. A three dimensional figure is mechanically attached and electrically linked to the housing at one end thereof, opposite the player's side.

The housing is generally rectangular in planform and of suitable height to contain the required mechanical and electrical components therein. The top includes a recessed playing field similar to that common to most pinball machines. Disposed on the playing field and through the surface thereof, are provisions which interact with a ball during play. A plurality of rotary spinners are provided which are adapted to randomly alter the ball's travel path as it comes into tangential contact with each rotary spinner. The rotary spinners are operably connected to a drive assembly which mechanically communicates with a drive motor. The drive assembly comprises a plurality of pulleys connected to the drive motor by a system of endless belts. In this manner, power requirements are significantly reduced, since only a single drive motor is required. A plurality of active bar bumpers are also operably connected to the drive assembly by additional pulleys and gearing. The active bar bumpers are adapted to engage and redirect the ball by means of a camming mechanism which is enabled upon impact.

A novel scoring mechanism is employed which relies on the drag imparted to the drive system caused by ball impact with a rotary spinner or active bar bumper, to electrically communicate a signal to an electronic controller which will be discussed in greater detail hereinbelow. The mechanism comprises part of the drive system wherein a first pulley is press fit onto an electrically conductive shaft which rotates one of the rotary spinners. The first pulley is mechanically driven by a second pulley through a torsion spring having upper and lower ends, disposed on the spinner shaft and fixedly attached at the lower end to the second pulley. The upper end extends radially outward from the shaft and bears against a pin integral with the first pulley. A conductive slip ring is disposed on the exterior of a hub extending downwardly from the second pulley, and has a tab which extends upwardly in circumferential alignment with the pin relative to the shaft. The conductive hub and shaft are energized by a pair of brushes which electrically communicate with the electronic controller to form a scoring relay. When a ball impacts a rotary spinner or an active bar bumper, the associated drag torque causes the first pulley to temporarily slow down. This causes the pin to bias the spring against the tab of the slip ring, thereby energizing the relay and generating a scoring signal.

The playing field is adapted to provide suitable space for a ball in play to travel between the rotary spinners, active bar bumpers, and other hardware in random fashion. A plurality of flippers linked by a mechanism as is well known in the art, are disposed near the player's side of the housing. A spring loaded handle which extends into a ball guide shaft to direct each ball into play is similarly disposed. In addition to the rotary spinners and bar bumpers, the playing field includes standard elastic bumpers, guide slots, and at least one "ball trap" which has a "kick out" mechanism for reintroducing the ball into play after a certain time period has elapsed. A "hidden ball channel" and associated mechanism is also provided within the housing near the side opposite the player.

A plurality of target sensor switches are strategically located on the playing field near the elastic bumpers, guide slots, ball guide shaft and other locations, to generate and send a scoring signal to the electronic controller. Similarly, the "ball trap" and "hidden ball channel" include switch mechanisms for generating "reverse scoring" signals. A ball bounce-back mechanism behind the main flippers is provided to reintroduce a "lost" ball into play without warning. A plurality of lights which communicate with the electronic controller are disposed on the playing field to convey information to the player with respect to how many balls are remaining before game's end.

The electronic controller communicates with the scoring mechanisms described above, and is programmed to score points based upon the interaction between the ball in play and hardware on the playing surface. The electronic controller can also subtract points during certain conditions, such as when the ball enters the "ball trap" or "hidden ball channel." A dedicated voice integrated circuit (IC) also communicates with the electronic controller to provide digitally stored sounds through an audio speaker in response to certain play situations. The electronic controller also generates electronic sounds when the target sensor switches are tripped. The electrical systems are powered either by DC batteries or through an A/C adapter.

The three dimensional figure is mechanically attached to the housing such that it may translate relative thereto. The figure includes a body, head and a pair of arms attached to the body below the head. The figure is articulated and acts an "opponent" to the player. Within the figure is disposed a mechanism for translating the figure relative to the housing and for moving the arms of the figure relative to the body. At least one arm is adapted to move such that it bangs its fist on the housing against a spring loaded mechanism for raising and lowering one side thereof relative to a support surface to change the level of play difficulty without warning. The mechanism includes provisions for imparting periodic movements such that the figure's motion is random and entirely independent of what the player is doing. Provisions for illuminating parts of the figure, and the audio speaker described above may be located within the figure to produce a "speaking" effect.

In accordance with the present invention, it is an object thereof to provide a pinball machine which includes an interactive, three-dimensional figure that acts as an "opponent" by mechanically altering the play conditions, and which further include provisions for generating visual and audible effects.

It is yet another object of the invention to provide a pinball machine which incorporates rotary spinners and active bar bumpers operably connected through a drive mechanism to a single motor.

It is still another object of the invention to provide a pinball machine which includes a scoring mechanism and relay which is responsive to the drag torque imparted on the drive system caused by ball contact with either a rotary spinner or active bar bumper.

It is still a further object of the present invention to provide a pinball machine which includes provisions for reducing the player's score during certain play conditions.

It is yet another object of the instant invention to provide a pinball machine which includes a flipper lockout mechanism for disabling flipper operation for a predetermined time period.

In accordance with these and other objects which will become apparent hereinafter, the invention will now be described with particular reference to the accompanying drawings.

DETAILED DESCRIPTION OF THE PREFERRED EMBODIMENT

Figure 14:
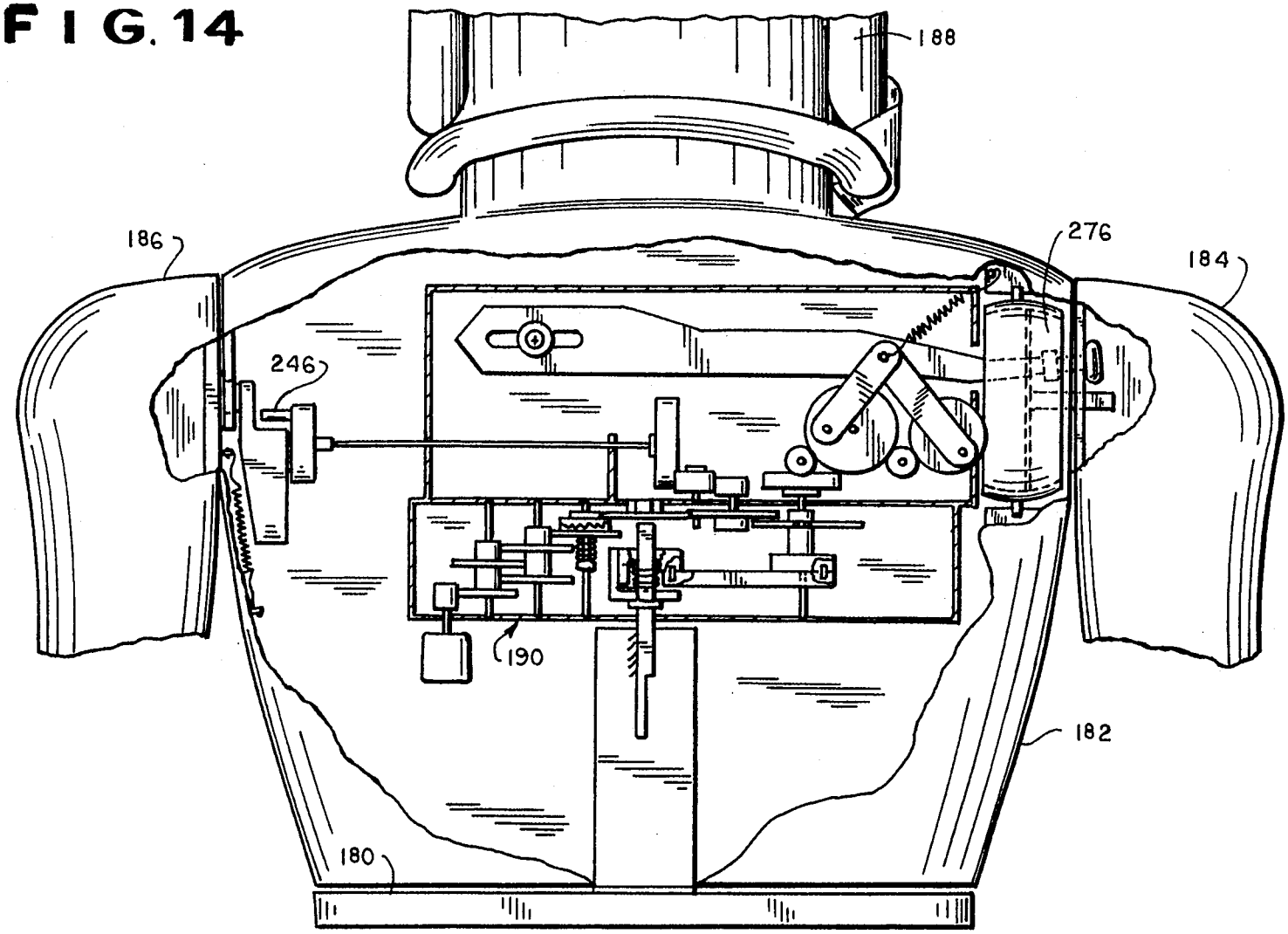
FIG. 14 is a rear elevational view of the three dimensional figure with a cutaway of the interior mechanism.

With reference to the several views of the drawing, and in particular FIGS. 1–4, there is depicted a pinball machine generally referred to by the reference numeral 10, which is primarily comprised of housing 12 and attached three-dimensional FIG. 14.

Referring now to FIGS. 1–5, Housing 12 may be fabricated from injection molded plastic or the like and is generally rectangular in planform and of suitable height to contain the mechanical and electrical components to be discussed in greater detail hereinbelow. Housing 12 is defined by first end 18, second end 20, and a recessed playing field 22 interposed therebetween which extends downwardly from the top of housing 12, bounded by front and rear walls 24 and 26, respectively, and side walls 28 and 30, respectively. Playing field 22 has a plurality of apertures defined therethrough to accommodate various ball path-altering provisions. In the preferred embodiment, a plurality of rotary spinners 32 and active bar bumpers 34 are mechanically connected to drive mechanism 36 which is located below playing field 22 in an interior volume 38 defined within housing 12, the internal mechanics to be discussed in greater detail hereinbelow. A clear plastic cover 23 is attached to housing 12 over playing field 22.

Figure 1:
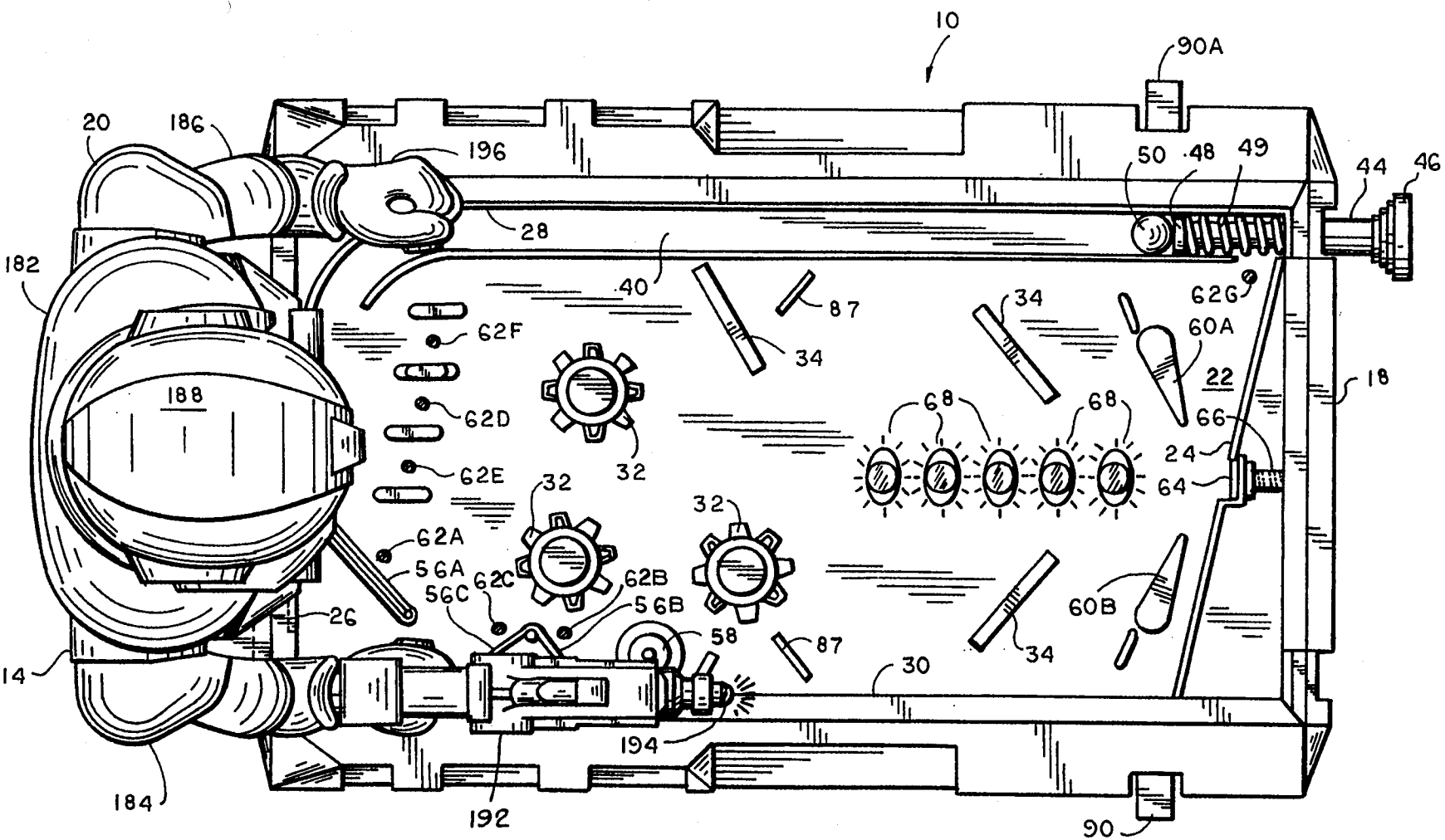
FIG. 1 is a top plan view of the pinball machine with an attached three dimensional figure.
Figure 2:
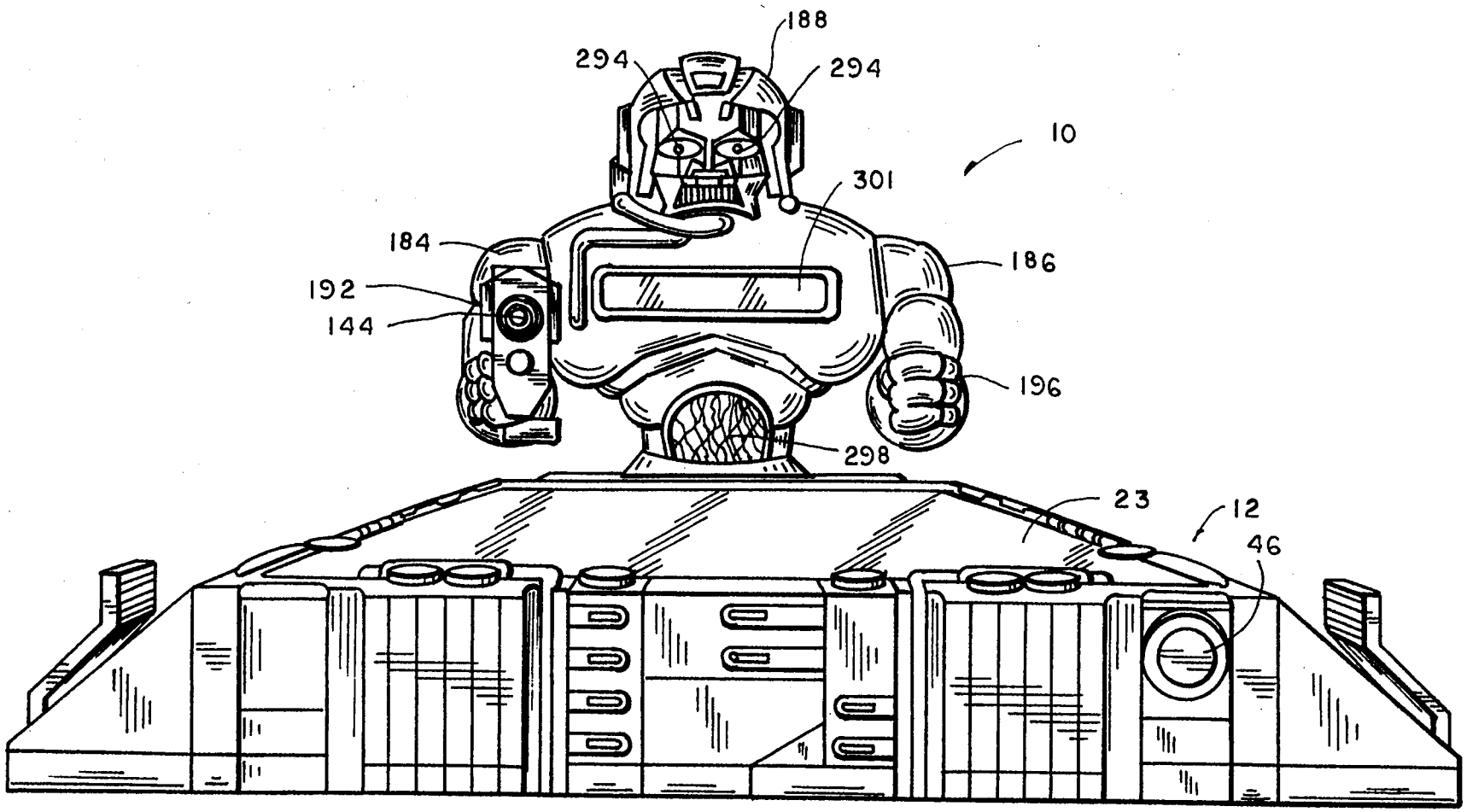
FIG. 2 is a front elevational view thereof.
Figure 3:
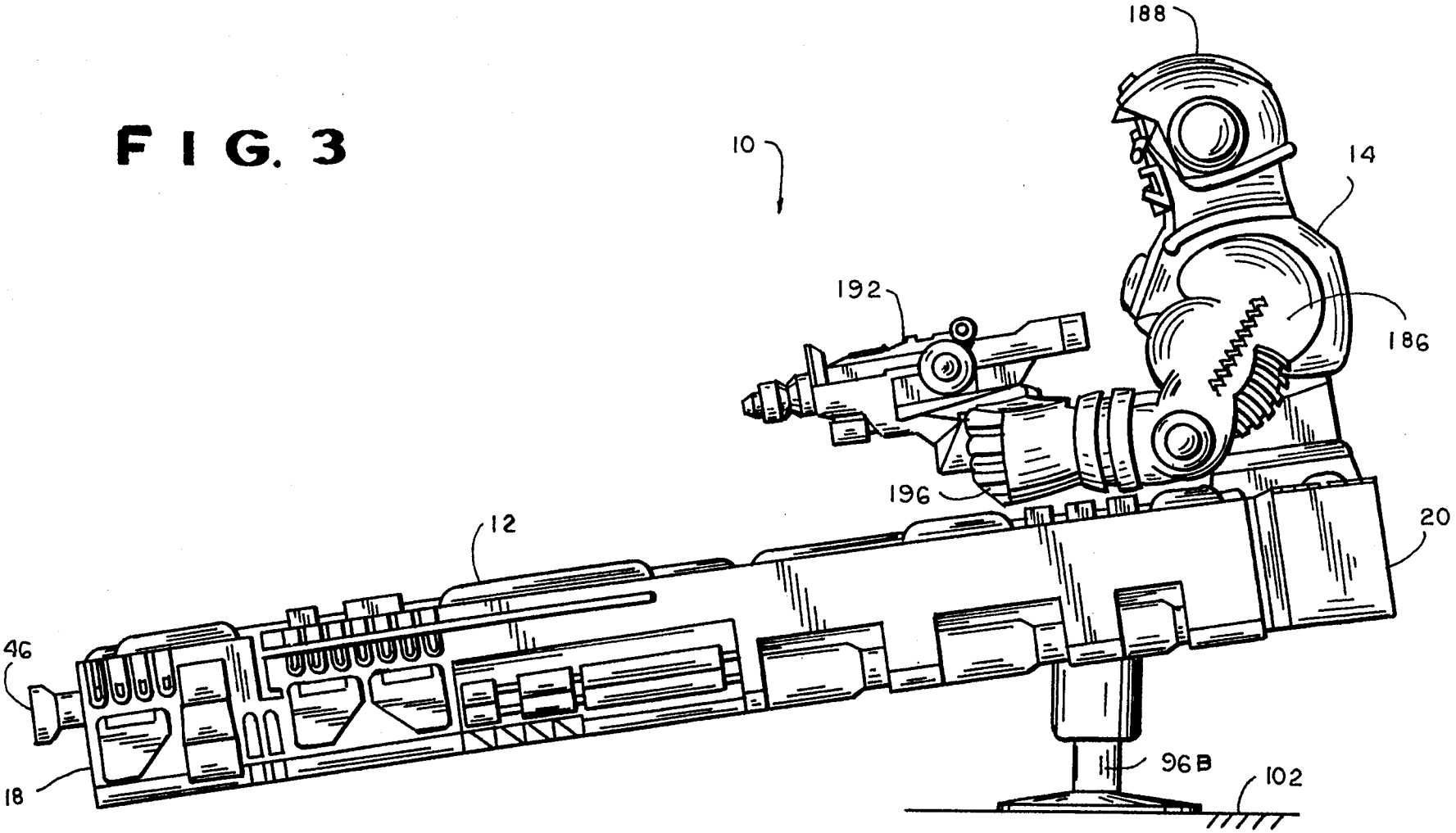
FIG. 3 is a right side elevational view thereof.
Figure 4:
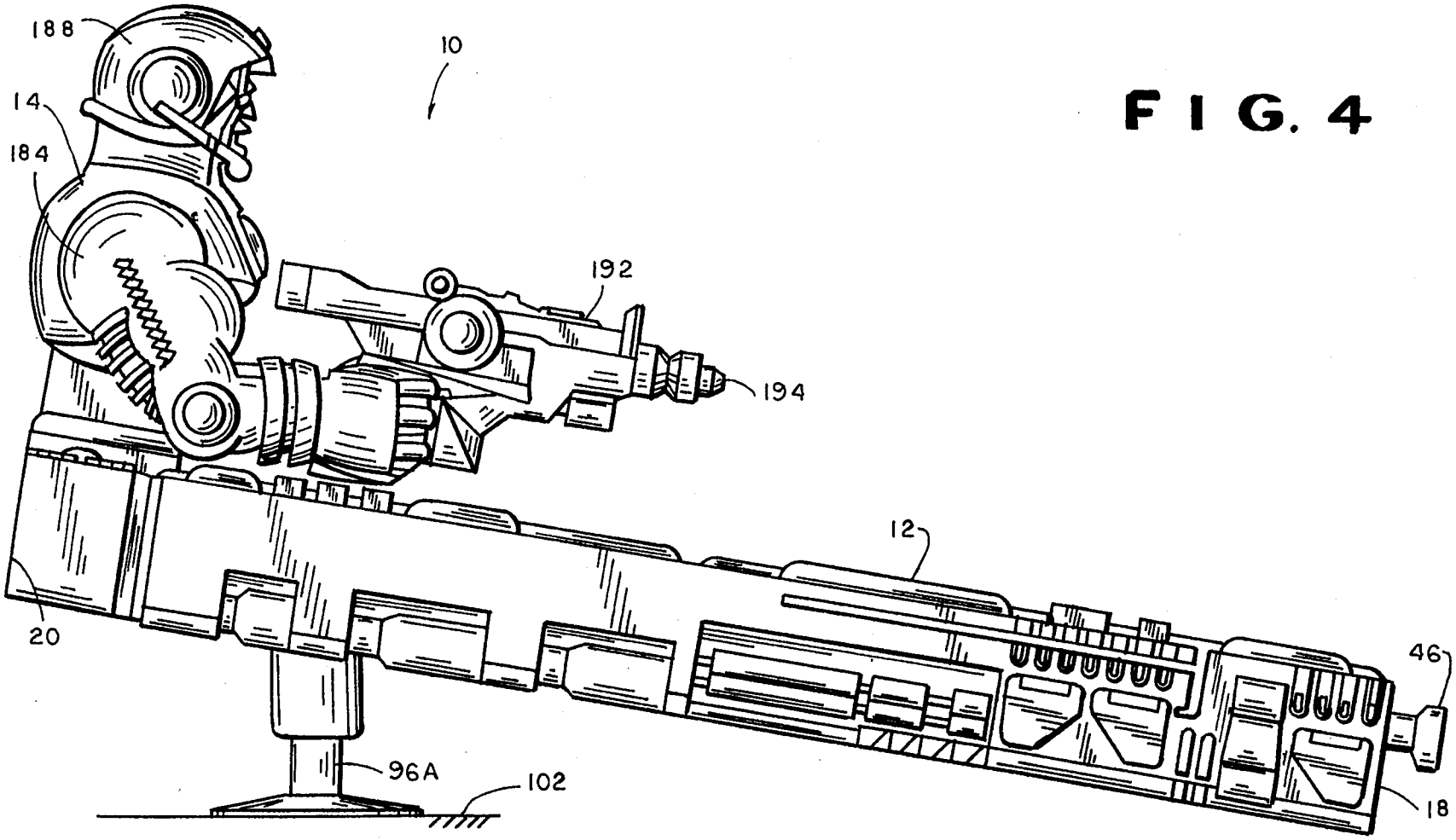
FIG. 4 is a left side elevational view thereof.
Figure 5:
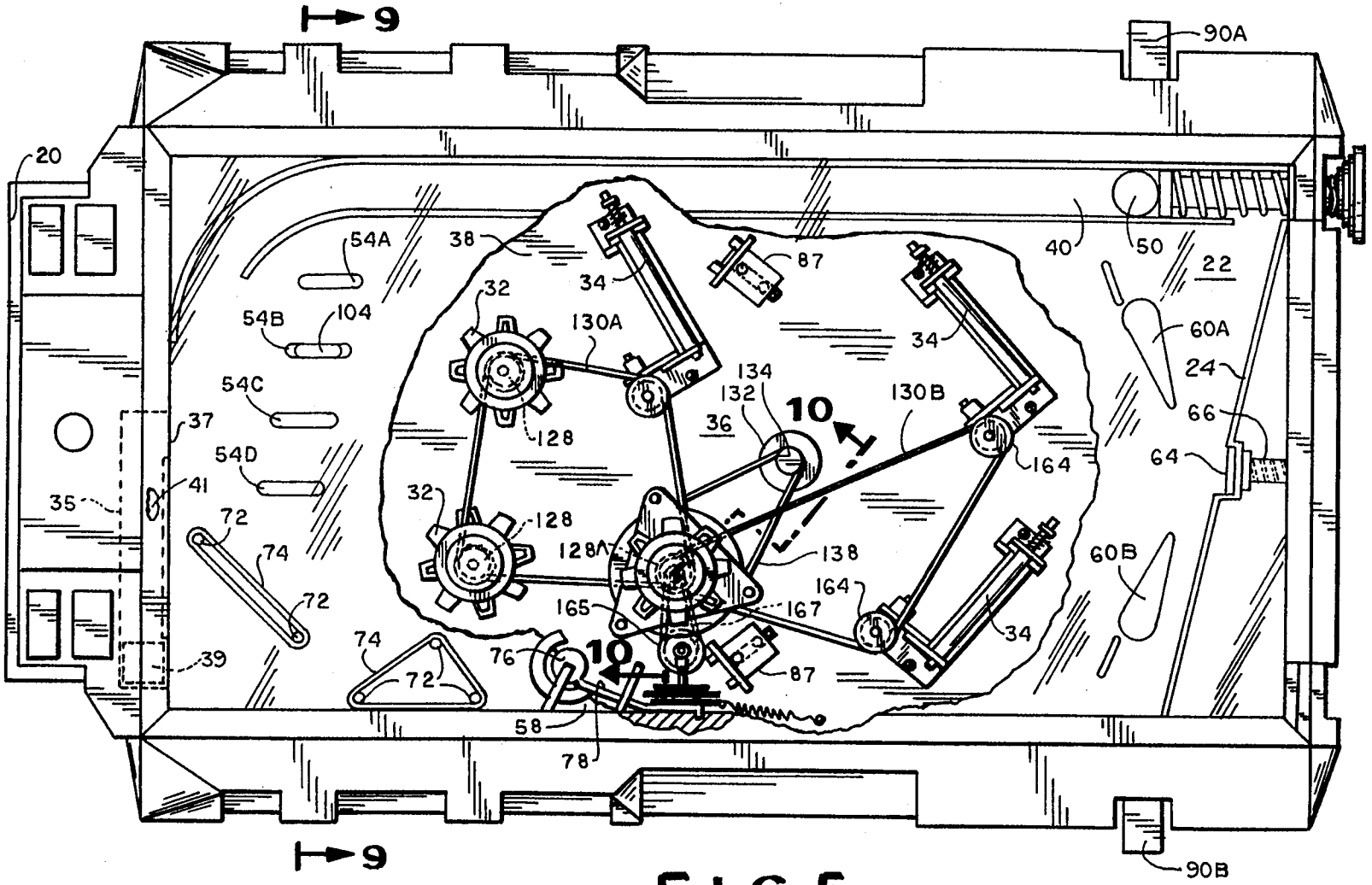
FIG. 5 is a top plan view thereof, having a cutaway in the playing field depicting the arrangement of the the drive assembly.

Referring now to FIGS. 1 and 5, a ball launch guide 40 is disposed near one side of housing 12. Launch guide 40 is bounded by wall 42 which is offset a nominal distance from, and parallel to, side wall 28. A spring-loaded pull knob 44 having a grasping handle 46, contact end 48, and an intermediate body portion having compression spring 49 disposed thereon, is collinearly mounted through housing 12 along the longitudinal extent of launch guide 40. When knob 44 is fully extended, ball 50 pops out into launch guide 40 and expelled by subsequently releasing knob 44. Once ball 50 exits launch guide 40, it is in play and may come into random contact with slot walls 54A, 54B, 54C and 54D, inactive bumpers 56A, 56B and 56C, hidden ball trap 58, flippers 60A and 60B, and a plurality of target sensor switches generally referred to by the reference numeral 62. Target sensor switches 62 are adapted to close during contact with the ball as it progresses through play on playing field 22. Disposed within rear wall 24 is a spring loaded ball bounce back panel 64 attached to compression spring 66. Rear wall 24 is angled relative to the transverse extent of playing field 22 to direct ball 50 into launch guide 40. A plurality of LEDs 68 are strategically positioned on the playing field and are illuminated to convey the number of balls remaining in play. Target Sensor switches 62 and LEDs 68 are connected to an electronic controller generally referred to by the reference numeral 70, as is other hardware to be described in greater detail hereinbelow.

Inactive bumpers 56 are typically comprised of a support structure 72, having an elastic material 74 stretched around the periphery thereof. In this manner, ball 50 is redirected at varying angles of incidence about playing field 22 as is well known in the art of pinball machine design. Target sensor switches 62A, 62B and 62C are strategically located near inactive bumpers 56A, 56B, 56C, respectively. Target sensor switches 62C, 62D, and 62E are disposed on playing field 22 between slot walls 54A and 54B, 54B and 54C, 54C and 54D, and 54D and 54E, respectively. Target sensor switch 62F is disposed on playing field 22 in launch guide 40 such that a dedicated "launch" sound is generated as will be discussed in greater detail hereinbelow. Target sensor switch 62G is situated near rear wall 26 and is activated when ball 50 is "lost" from play prior to being reintroduced into launch guide 40, causing a dedicated "lost ball" sound and triggering LEDs 68 such that the number of balls remaining in play is displayed on playing field 22.

Figure 13:
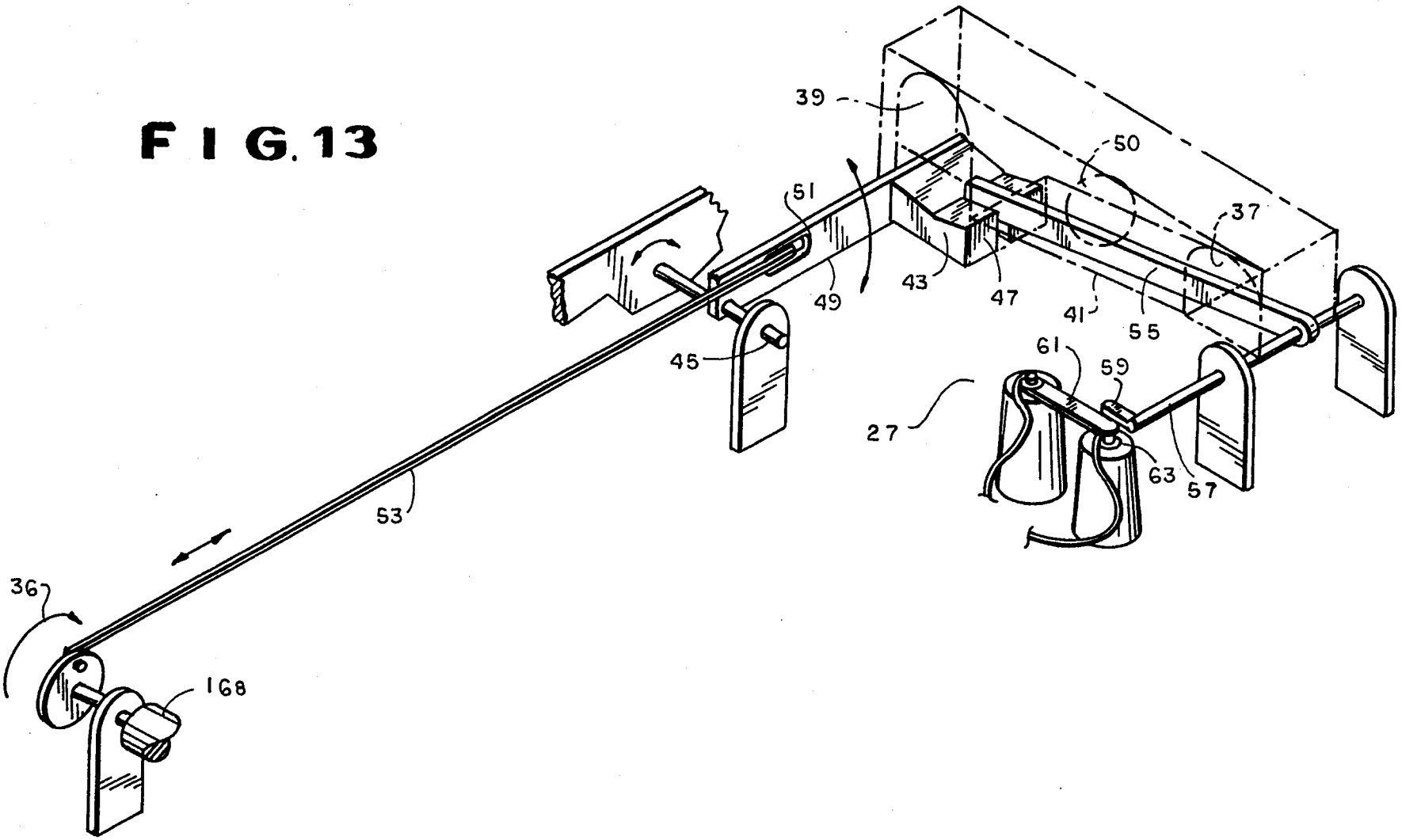
FIG. 13 is a perspective view of the ball channel and ball lift arm assembly.

Referring now to FIGS. 5 and 13, rear wall 26 near FIG. 14 includes a hidden ball channel 35 which provides the illusion of ball 50 disappearing "into" FIG. 14. Channel 35 includes an entrance 37 disposed substantially near the center of playing field 22, and an exit 39 near side wall 30. Channel 35 has an inclined floor 41 so as to permit ball 50 to roll towards exit 39. A ball lift member 43 is pivotally attached to housing 12 at pivot 45. Lift member 43 includes a slotted ball ejector 47 and a lift arm 49 which includes slot 51 for attaching connecting rod 53. Rod 53 is attached to drive mechanism 36 such that it constantly oscillates back and forth, thereby raising ball ejector 47 to reintroduce ball 50 back into play. A ball channel sensor switch 27 comprises a sensor arm 55, pivotally attached to housing 12 at pivot 57. Ball sensor arm 55 includes a tab 59 to bias conductive strip 61 against contact 63, thereby closing the circuit and generating a scoring signal.

Figure 6:
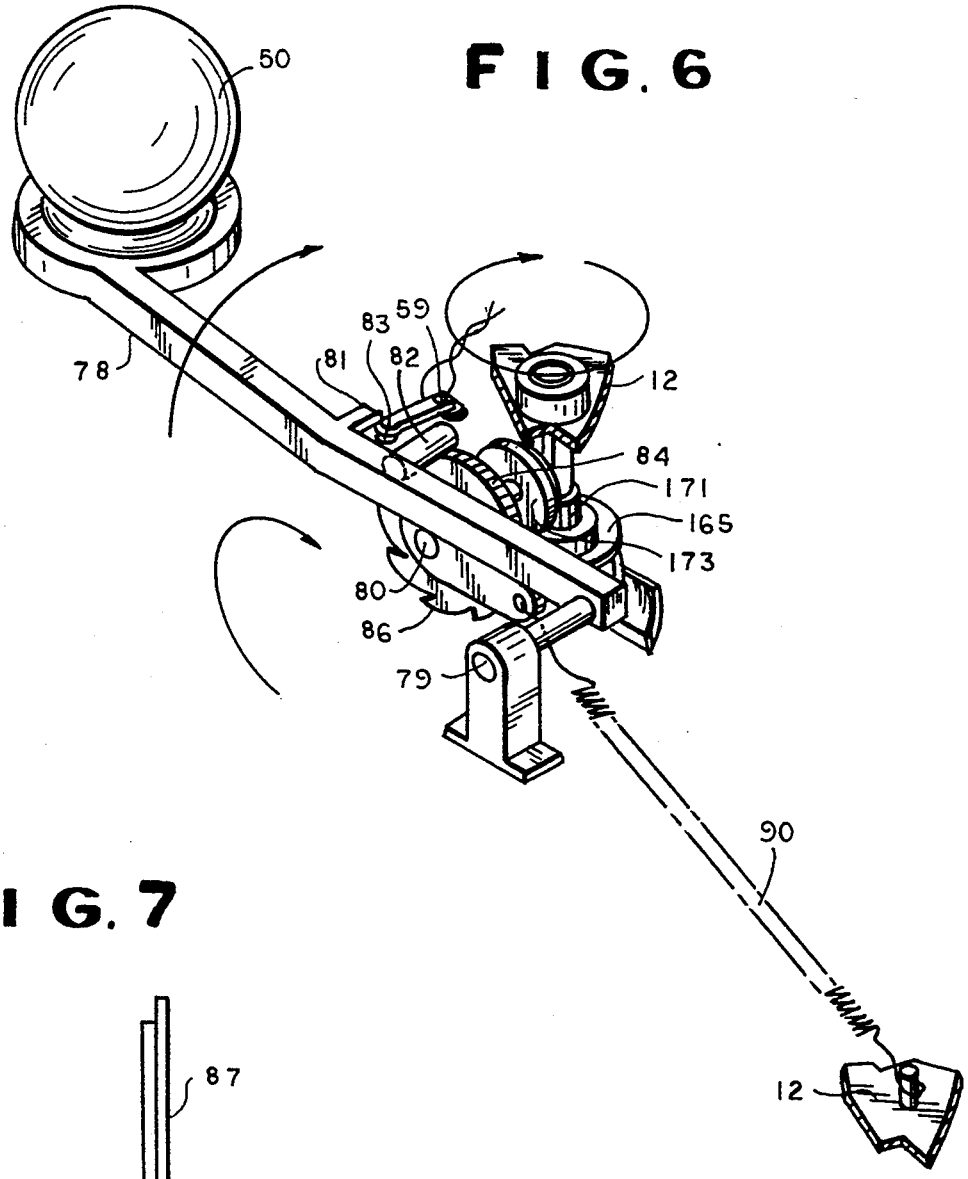
FIG. 6 is a perspective view of the ball trap mechanism.

Referring now to FIGS. 5, 6, and 6A–6C, Ball trap 58 is designed to retain ball 50 in a recessed position through aperture 76 for a predetermined period of time prior to being returned to playing field 22. FIG. 6 depicts a detail of the ball trap mechanism which comprises a ball driver arm 78, pivotally attached to housing 12 at pivot 79. Ball driver arm 78 includes a pin 82. A cam 84 having a flexible tang portion is slip fit on shaft 80 for free rotation relative thereto, adapted to engage ratchet member 86. Ratchet member 86 is press fit on shaft 80 which is constantly driven by a drive mechanism 36 as shown in FIG. 5. Cam 84 has a pin 88 to which a tension spring 90 is attached at one end and affixed at the other end to a portion of housing 12. When ball 50 enters trap 58, the weight of the ball causes ball driver arm 78 and pin 82 to urge the flexible portion of cam 84 against ratchet member 86 which rotates cam 84 until it engages pin 82 and pushes ball driver arm 78 upward. The tensile load imposed by tension spring 90, causes cam 84 to disengage from ratchet member 86 allowing it to return to its original position. A ball trap switch 85 is engaged when ball 50 comes into contact with ball driver arm 78, such that a scoring signal is generated and communicated to electronic controller 70, which then computes "reverse scoring," and subtracts points from the scoring indicia to be discussed below. Ball trap switch 85 includes a cantilevered conductive strip 59 which is urged against contact 83 by tab 81 on driver arm 78.

Figure 7:
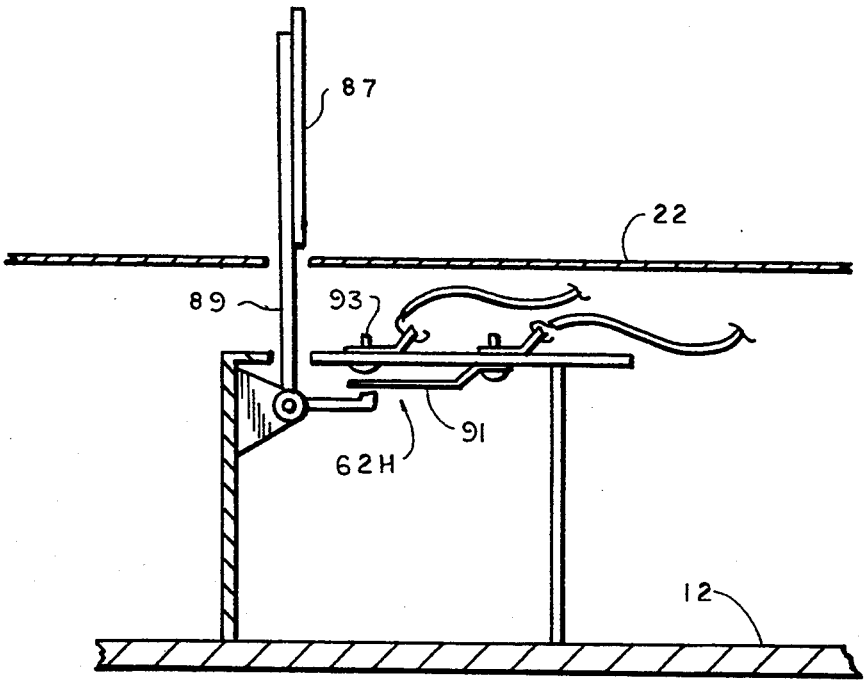
FIG. 7 is a detail of a robot target assembly.
Figure 6A:
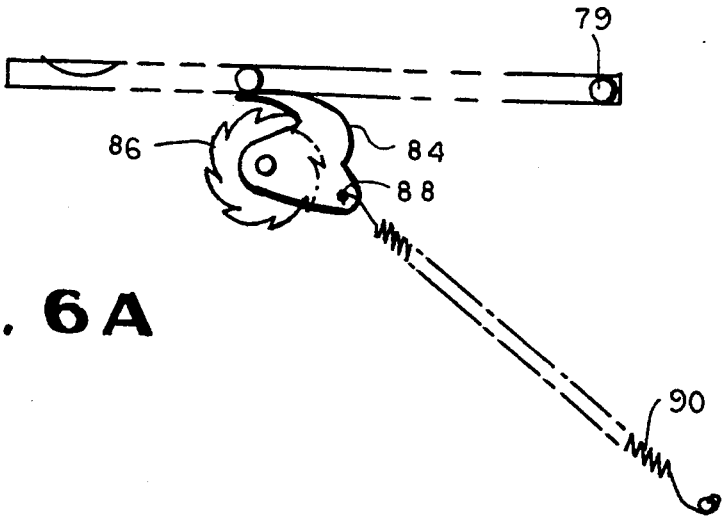
FIGS. 6A–6C depict the motion of the ball trap mechanism in sequence from when the ball enters the trap through ejection.
Figure 6B:
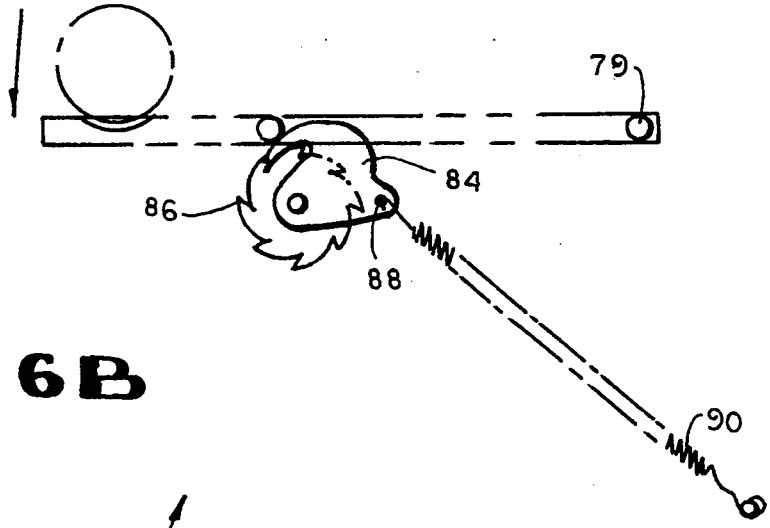
Figure 6C:
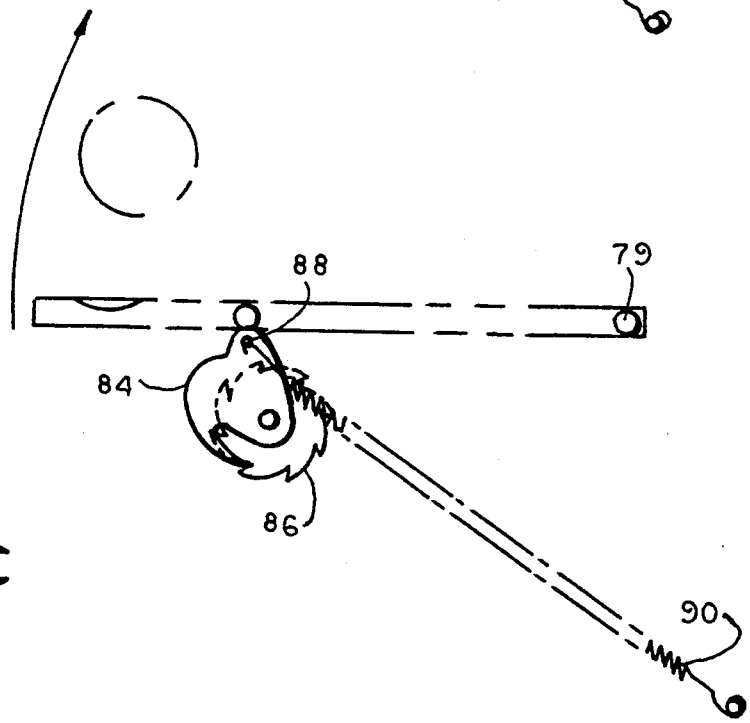
Figure 8A:
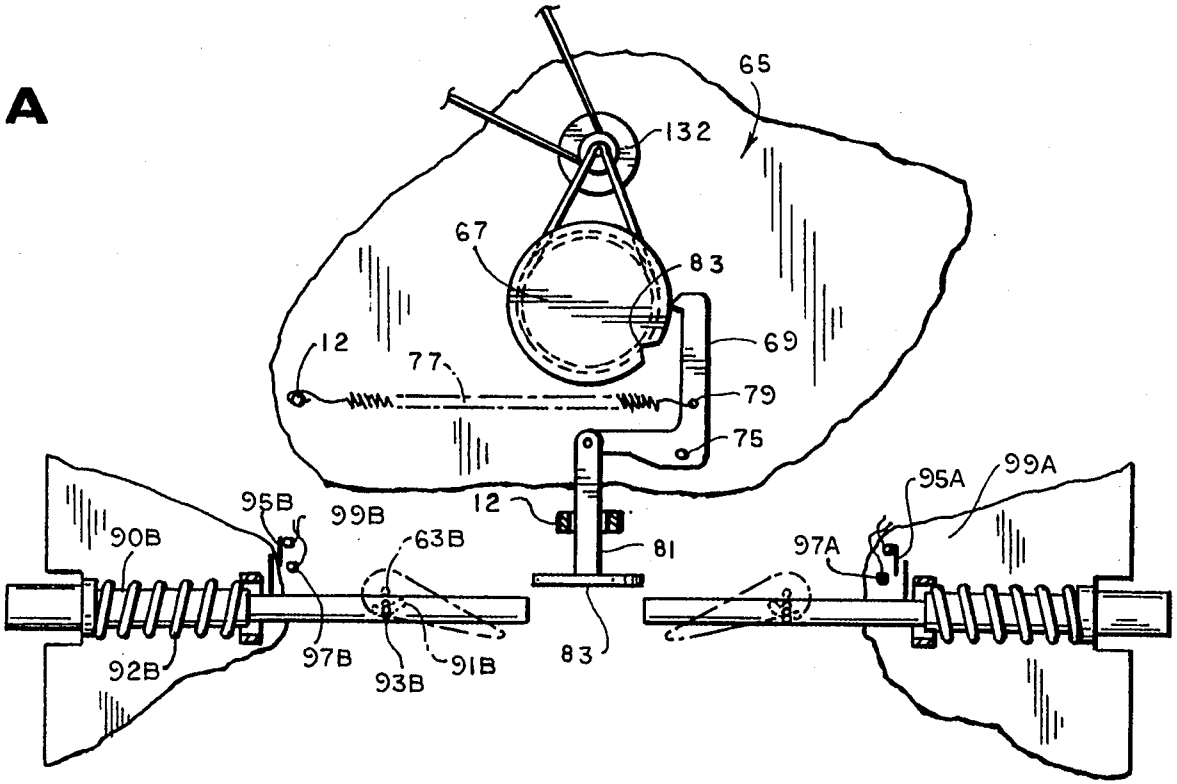
FIG. 8A plan view detailing the flippers and flipper lockout mechanism.
Figure 8B:
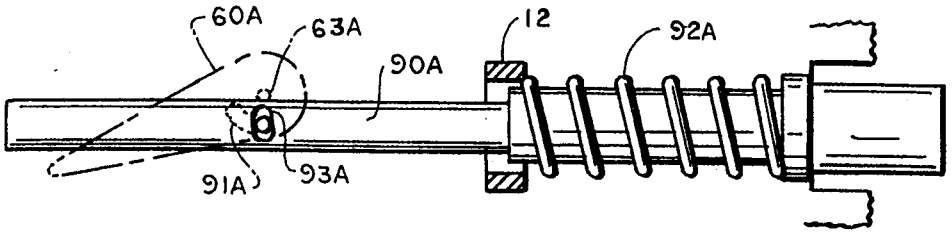
FIG. 8B is a plan view detailing a single flipper mechanism.

Additionally, there is at least one small plastic robot target 87 disposed on playing field 22 which enables target sensor switch 62H to generate create a scoring signal. Referring now to FIG. 7, target sensor switch 62H is comprised of an "L" shaped pivot arm 89 which is fixedly attached to target 87 and which extends through an aperture in playing field 22. When target 87 is struck by ball 50 in play, the lower leg of pivot arm 89 biases a cantilevered conductive strip 91 against eyelet 93.

Referring now to FIG. 1, 4, 8A and 8B, Flippers 60A and 60B are of standard design as is well known in the art, and generally comprise a plunger 90A and 90B having centrally disposed compression springs 92A and 92B, respectively, to return the flippers to the neutral position after actuation. Flippers 60A and 60B each include a radially disposed pin, 61A and 61B, respectively, relative to pivot points 63A and 63B, respectively. Pins 61A and 61B extend through arcuate slots 91A and 91B, respectively, in playing field 22, and through slots 93A and 93B, respectively, in plungers 90A and 90B, respectively. Plungers 90A and 90B enable flipper sensor switches 99A and 99B, respectively, which cause a dedicated electronic sound to be generated. Sensor switches 91A and 91B include tabs 93A and 93B on plungers 90A and 90B, respectively, which cause cantilevered contact strips 95A and 95B to close against contacts 97A and 97B, respectively. A flipper lockout mechanism 65 may be incorporated within housing 12. Flipper lockout mechanism 65 includes a low rpm cam 67 operably connected to drive motor 132 through endless belt 130C as will be discussed in greater detail below. A spring loaded cam follower 69 having a tip 71 in intimate contact with the peripheral surface 73 of cam 67 is pivotally attached at pivot point 75 to housing 12. Cam follower 69 includes a tension spring 77 attached at one end to pin 79, and affixed at the opposite end to housing 12. A plunger 81 having a "T-shaped" end 83 is attached to cam follower 69 by pin 85. Cam 67 rotates cam follower 69 periodically with respect to pivot point 75 when tip 71 engages notch 83 in the profile of cam 67, causing "T-shaped" end 79 to translate into a position between flipper plungers 90A and 90B, thereby temporarily preventing flipper operation.

Figure 9:
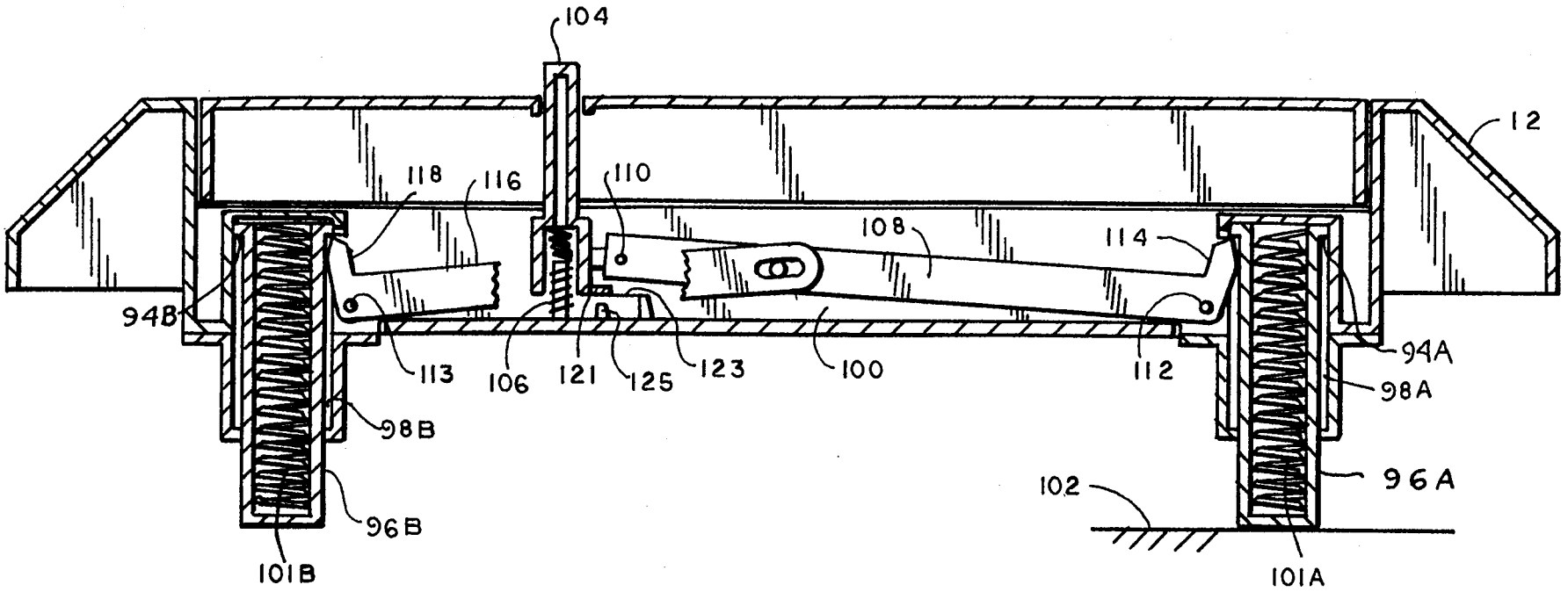
FIG. 9 is a sectional view along line 9—9 in FIG. 5, depicting the table lift mechanism.

Referring now to FIG. 9, Housing 12 includes a pair of spring loaded legs, 96A and 96B slidably disposed within slots 94A and 94B. Legs 96A and 96B each contain a flanged area 98A and 98B, respectively, adapted to interact with a mechanism 100 for changing the angle of incidence of housing 12 relative to a support surface 102. Legs 96A and 96B include compression springs 101A and 101B for urging legs 96A and 96B to extend downwardly within slots 98A and 98B upon interaction with mechanism 100. Mechanism 100 includes a plunger 104 having compression spring 106 in alignment therewith. Attached to plunger 104 is a first link member 108 pivotally attached thereto at end 110. First link member 108 is attached to housing 12 at pivot 112, and includes a specially shaped extension 114 which is disposed below flanged area 98A of leg 96A. A second link member 116 is pivotally attached to first link member 108 in the approximate center thereof and to housing 12 at pivot 113. It has specially shaped extension 118 which is disposed below flanged area 94B of leg 96B. During the game, the fist of three-dimensional FIG. 14 will randomly impact plunger 104 causing links 108 and 116 to rotate extensions 114 and 118 away from legs 96A and 96B, respectively, permitting compression springs 101A and 101B to push legs 96A and 96B, respectively, within slots 98A and 98B, respectively, thereby raising housing 12 relative to support surface 102. Switch 120 is associated with plunger 104 which, when activated, sends a scoring signal to electronic controller 70. Switch 120 includes a tab 121 attached to plunger 104 which biases cantilevered conductive strip 123 against contact 125.

Figure 10:
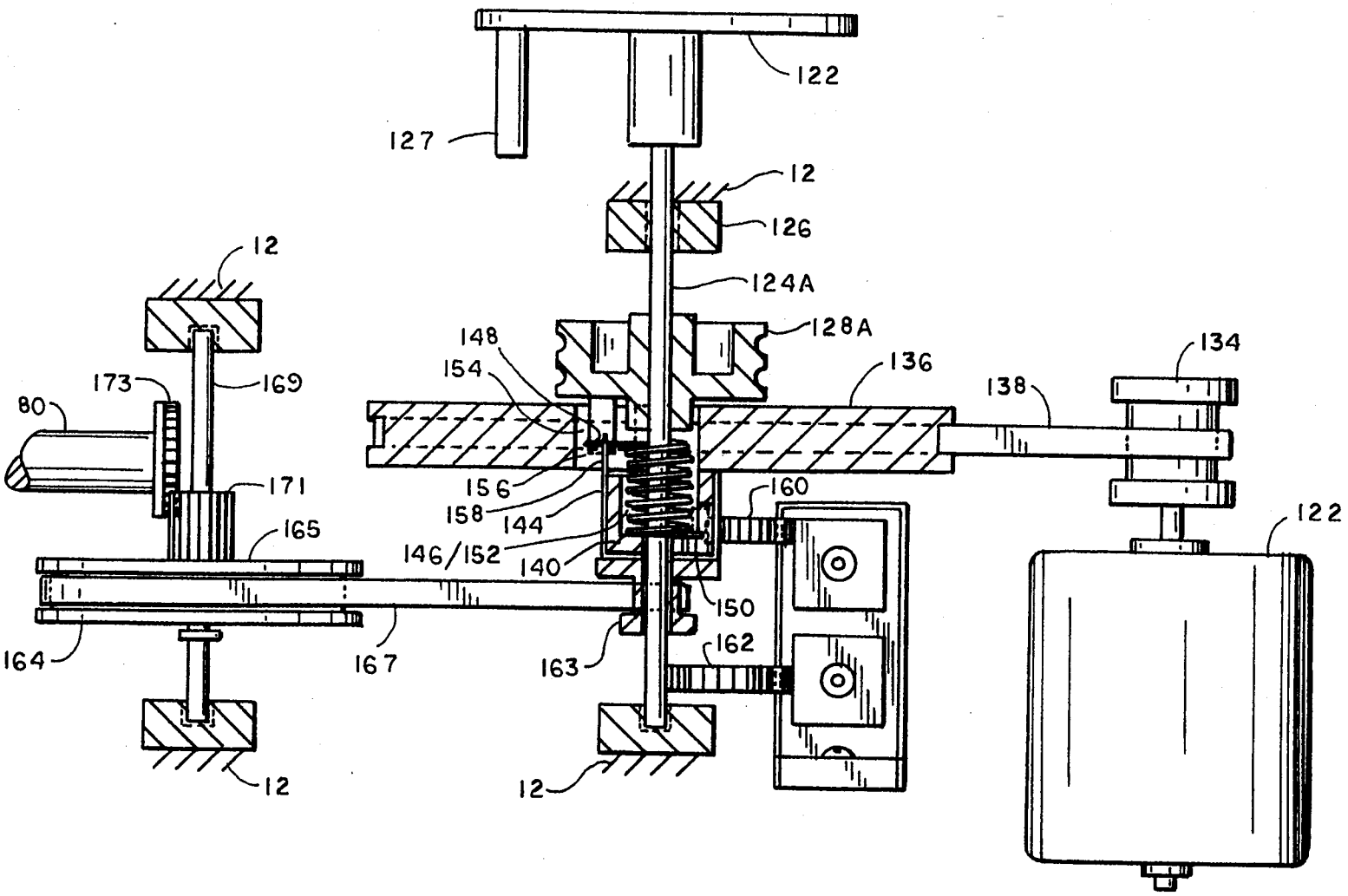
FIG. 10 is a sectional view along line 10—10 in FIG. 5, showing detail of the scoring relay and drive mechanism.
Figure 11:
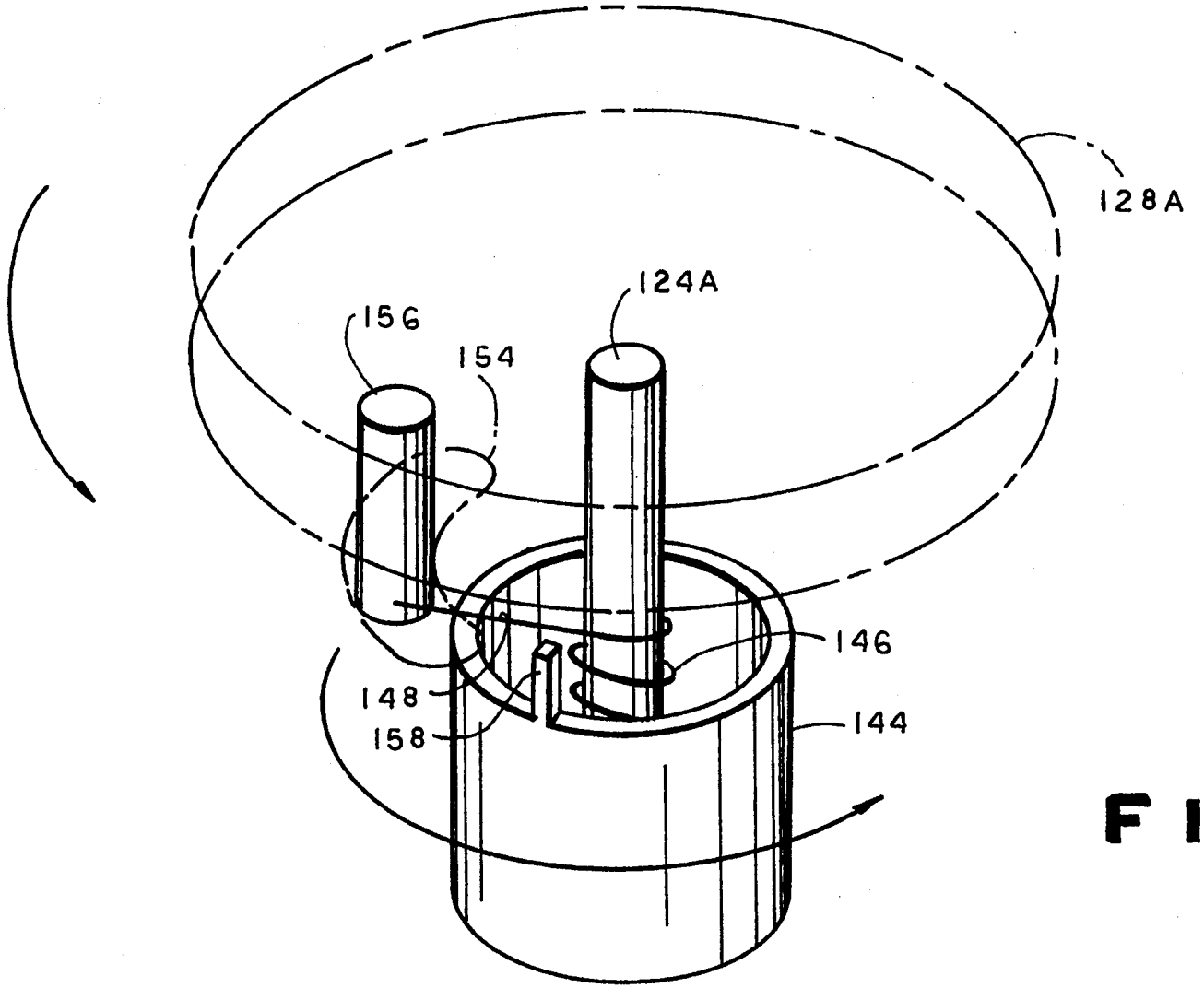
FIG. 11 is a detail of the scoring relay showing the upper spring extension which drives the upper pulley.
Figure 12:
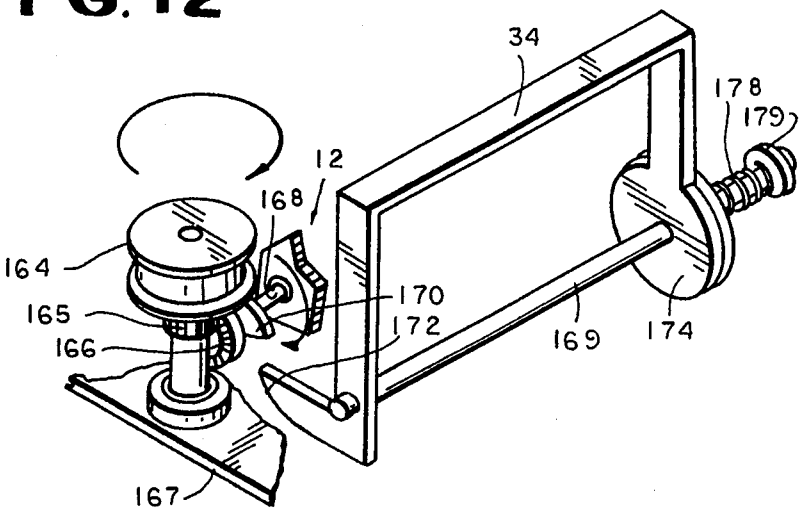
FIG. 12 is a perspective view of an active bar bumper.
Figure 12C:
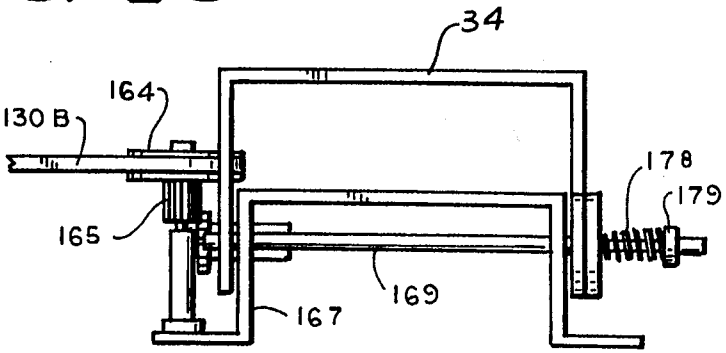
FIG. 12C is a rear elevational view thereof.
Figure 12A:
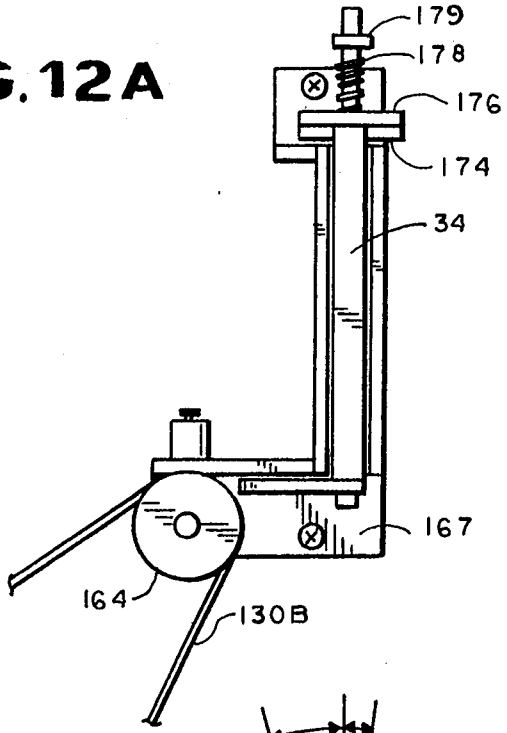
FIG. 12A is a top plan view thereof.
Figure 12B:
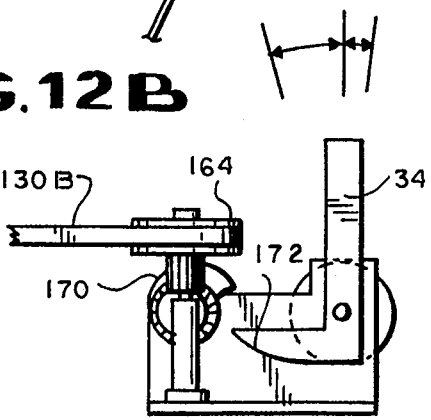
FIG. 12B is a side elevational view thereof.

Referring now to FIGS. 5, 10, and 11 a plurality of rotary spinners 32 are operably connected to drive mechanism 36, which also provides an integral scoring relay 36A, triggered when ball 50 comes into contact with a rotary spinner 32 or active bar bumper 34. Each rotary spinner 32 is comprised of a spin bumper 122, fixedly attached to an elongated shaft 124. Spin bumper 122 includes a radially disposed pin 127 extending downardly towards playing field 22. Shaft 124 extends through an aperture in playing field 22 and guide bushing 126. A first pulley 128 is press-fit on shaft 124. All rotary spinners 32 are driven by a single endless belt 130A attached to a plurality of pulleys 128. Active bar bumpers 34 are likewise driven off belt 130A as will be discussed in greater detail hereinbelow. Power is provided by motor 132, which transmits torque to the system through pulley 134. Pulley 134 communicates with main drive pulley 136 through endless belt 138 in such a manner as to provide the required reduction ratio. Main drive pulley 136 drives one pulley 128A, fixedly attached to elongated shaft 124A, which then provides torque to all other pulleys 128. Main drive pulley 136 and pulley 128A are interconnected by a torsion spring mechanism which is part of the scoring relay. Main drive pulley 136 defines a hub 140 extending downwardly from one side thereof. Hub 140 includes an interior chamber 142 and an outer conductive surface such as slip ring 144. Torsion spring 146 has an upper radial extension 148, a lower radial extension 150 and a body 152 disposed on shaft 124A. Lower radial extension 150 is fixedly attached to the interior of hub 140 and upper radial extension 152 extends into a recessed area 154 in drive pulley 136. Pulley 128A includes a pin 156 extending downwardly from the bottom side thereof, which makes contact with upper radial extension 148 of torsion spring 146. During operation, drive pulley 136 transfers torque to pulley 128A through torsion spring 146. When a drag torque is imposed on any one of pulleys 128, pin 156 on pulley 128A biases upper radial extension 152 against tab 158 in slip ring 144, thereby closing the scoring relay. A first brush 160 communicating with slip ring 144 and a second brush 162 communicating with shaft 124A, are electrically associated with electronic controller 70, and send a scoring signal every time a ball 50 impacts a rotary spinner 32 or active bar bumper 34. Attached near the bottom of shaft 124A is pulley 163, which drives pulley 165 through endless belt 167. Pulley 165 is fixedly attached to shaft 169 which in turn drives crown gear 171. Crown gear 171 transfers torque to shaft 80 of ball trap 58, through gear 173.

Referring now to FIGS. 12 and 12A–12C, each bumper 34 is configured in the shape of an inverted "U" and is operably connected to endless belt 130B by a pulley 164. Pulley 164 drives gear 165 which in turn drives crown gear 166 on shaft 168 which is affixed to housing 12 by frame 167. Shaft 168 includes a cam member 170 connected to crown gear 166, adapted to engage a follower member 172 of bumper 34. Bumper 34 includes a plastic hub 174, which is press fit on shaft 169, and an inertial disk 176 is spring loaded by compression spring 178 against hub 174 and retainer 179 to dampen out vibration. It is to be understood, that in lieu of the numerous pulleys described in the mechanisms above, a fully geared or other equivalent mechanism may be substituted within the scope of the invention.

Figure 14B:
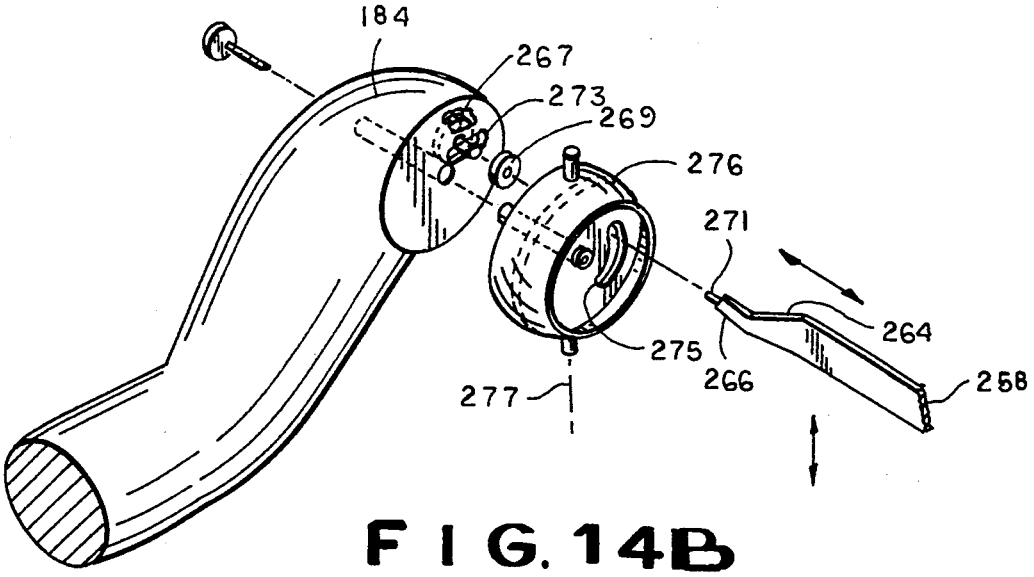
FIG. 14B is a perspective view of the right arm mechanism.
Figure 14A:
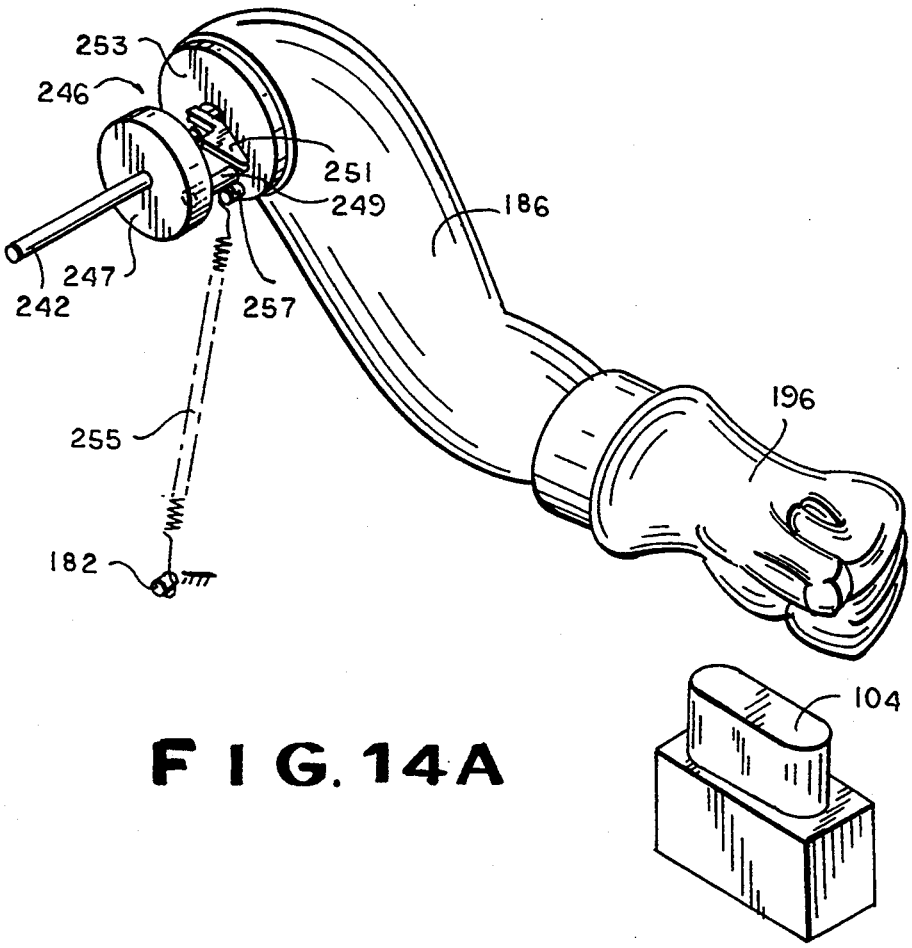
FIG. 14A is an exploded perspective detailing the left arm mechanism.
Figure 14C:
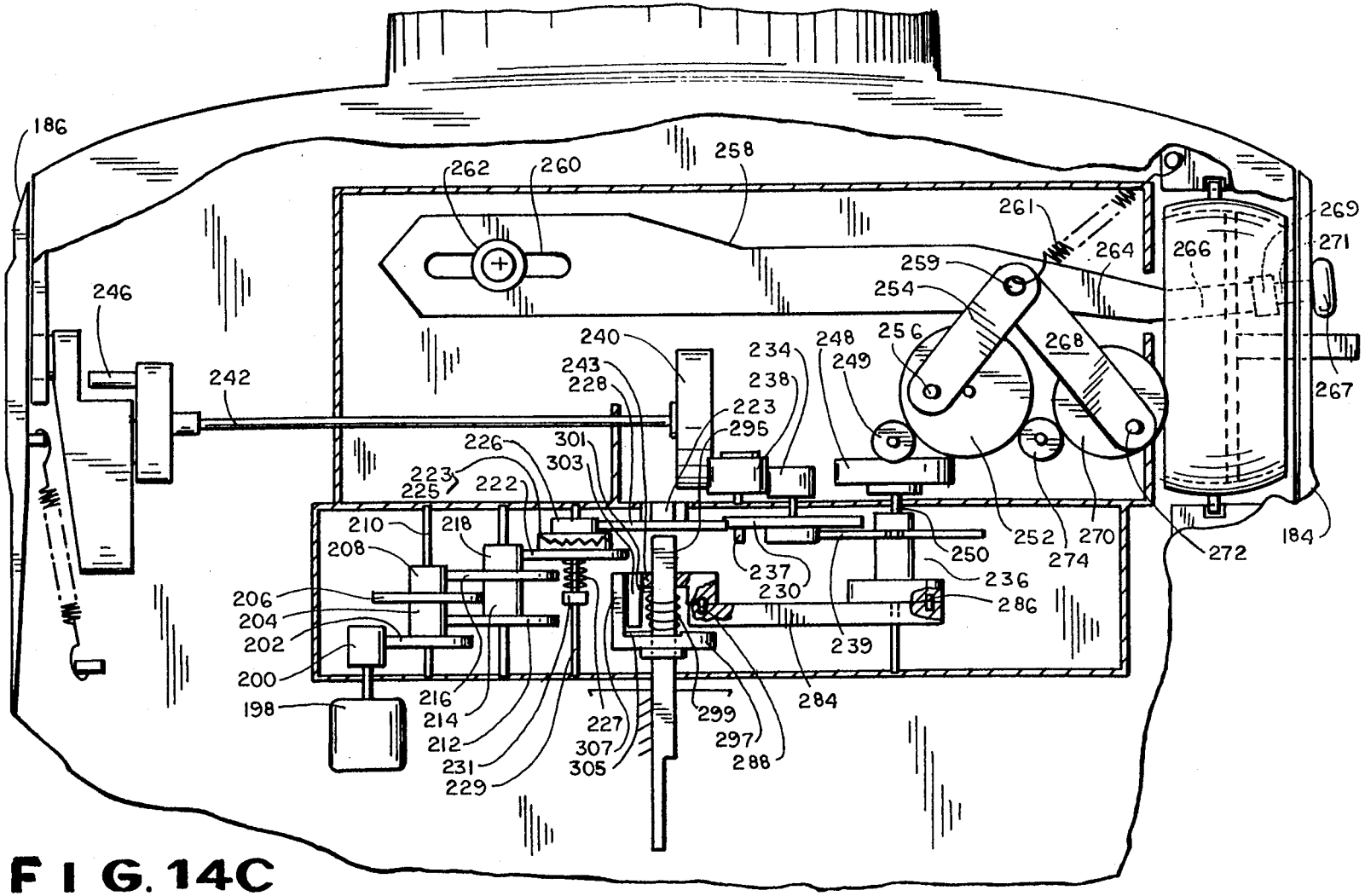
FIG. 14C is an enlarged detail view of FIG. 11.

Referring now to FIGS. 14 and 14C, three-dimensional FIG. 14 is attached to housing 12 near second end 20 thereof atop boss 180. FIG. 14 is generally comprised of a body 182, right arm 184, left arm 186 and head 188, and may be fabricated from injection molded plastic or the like. The figure in the illustrative embodiment is characterized as a robot, but may be of numerous configurations depending on the desired game motif. Left arm 186 is operably connected to a mechanism 190 which enables it to rotate at the shoulder relative to body 182. Referring now to FIGS. 1–4 a toy gun 192 is unitarily molded with to right arm 184. Gun 192 includes LED 194 which communicates with electronic controller 70. Left arm 186 includes fist 196 which randomly pounds on plunger 104 to raise the angle of play as described in the foregoing. Right arm 184 is also connected to mechanism 190.

Mechanism 190 simultaneously controls all the movements of FIG. 14, including left arm 186, and right arm 184. Mechanism 190 includes motor 198 and associated pinion gear 200. Gear 200 drives a reduction mechanism comprised of gears 202, 204, 206 and 208 on shaft 210; and gears 212, 214, 216, and 218 on shaft 220. Gear 218 transmits torque to slip clutch 224. Clutch 224 comprises lower gear 222 having clutch face 223 which is biased against clutch face 225 of gear 226 by compression spring 227. Gear 226 is press fit on shaft 229. Lower gear 22 is slip fit on shaft 229, and compression spring 227 is-held in place by retaining ring 231 press fit on shaft 229. Gear 226 engages gear 228 disposed along the robot's vertical axis on shaft 223. Gear 228 rotates driver 230 on a common shaft 232 with gear 234. Driver 230 forms part of geneva drive 236 to be described in greater detail hereinbelow.

Gear 234 transmits torque through idler gear 238 to crown gear 240. Gear 240 is attached to shaft 242 which in turn rotates left arm mechanism 246. As shown in FIG. 14A, left arm mechanism 246 comprises driver element 247 attached to shaft 242. Driver element 247 has pin 249 radially disposed thereon relative to the axis of rotation of shaft 242, which is adapted to engage cam follower rib 251 in left arm attachment surface 253. Left arm attachment surface 253 is pivotally attached to body 182 at the shoulder, and includes tension spring 255 attached to pin 257 at one end, and body 182 at the other end. Driver element 247 is constantly rotating. Left arm 186 is lifted during rotation of driver element 247 through approximately 20° of rotation. Arm 186 subsequently travels downward after pin 249 is rotated past follower rib 251 with assistance from tension spring 255 such that fist 196 slams down on plunger 104 during the resulting dwell period. Driver element 247 rotates through approximately 270° before raising left arm 186 in a subsequent cycle.

Geneva drive 236 transmits torque to crown gear 248 through shaft 250. Geneva drive 236 consists of driver 230 having radially disposed cam follower 237 which periodically engages cam 239 attached to shaft 250 and crown gear 248.

Crown gear 248 drives gear 249 which in turn drives gear 252. Gear 252 has link 254 attached at one end to radially disposed pin 256. Link 254 is attached at its other end to an elongated right arm actuator link 258, transversely disposed within body 182 by pin 259. A tension spring 261 extends from pin 259 and is affixed to a portion of body 182. Right arm actuator link 258 includes slot 260 near one end thereof through which retaining pin 262 secures actuator link 258 to FIG. 14. Actuator link 258 includes a joggle 264 which tapers into extension end 266. Another link 268 is attached to pin 259 at one end thereof, and gear 270 at the other end thereof at radially disposed pin 272. Interposed between gears 252 and 270 is idler gear 274.

Referring now to FIG. 14B, and particularly to extension end 266 of actuator link 258, extension end 266 includes bulbous portions 267 and 269 separated by rod 271. Bulbous portion 269 is fit into aperture 273 in right arm 184 at the shoulder thereof. Universal joint member 276 is defined by a generally round planform having parallel flat sides which define a slot 275 through which rod 271 of actuator link 258 is disposed and displaced a radial distance from vertical axis 277 of universal joint member 276. Universal joint member 276 is rotatably mounted within FIG. 14 along vertical axis 277. Actuator link 256 will move vertically and laterally in response to periodic motion of geneva drive 236 and the attached gear and link mechanism. In this manner, right arm 284 and attached gun 192 translate simultaneously both up and down and from side to side, as actuator link 258 causes universal joint member 276 to pivot about vertical axis 277, while slot 275 permits vertical motion of extension end 266 of actuator link 258 and thus, rotation of right arm 184 about horizontal axis 280.

Geneva drive 236 is also attached to link 284 by pin 286. Link 284 is attached to the torsion spring clutch assembly 292 which in turn imparts rotary motion to the entire structure of FIG. 14 relative to housing 12. Torsion spring clutch assembly 292 includes a clutch driver 243 slip fit on shaft 295. Clutch driver 293 is attached to link 284 through pin 288. A torsion spring 299 is slip fit over shaft 295 with a top extension 301 affixed to tab 303 of clutch driver 293, and a lower extension 305 affixed to tab 307 on clutch follower 297. Clutch driver 293 moves in response to periodic motion of link 284 by geneva drive 236 causing torque to be transmitted through torsion spring 299 to clutch follower 297. Since clutch follower 297 is fixed relative to shaft 295 which is in turn fixed relative to housing 12, FIG. 14 rotates relative to housing 12 in alternating motion from side to side.

FIG. 14 is adapted to light up and communicate various digitally stored sounds to the player. FIG. 14 includes "eyes" 294 which in a synchronized manner, light up in conjunction with "talking sounds" from speaker 296. Similarly, LED 194 in gun 192, flickers in conjunction with "machine gun sounds" to create the illusion of "shooting" the player. A clear plastic cover 309 is disposed on the stomach area of FIG. 14, to expose representative "innards" which are visible when interior light 298 is illuminated.

Figure 15:
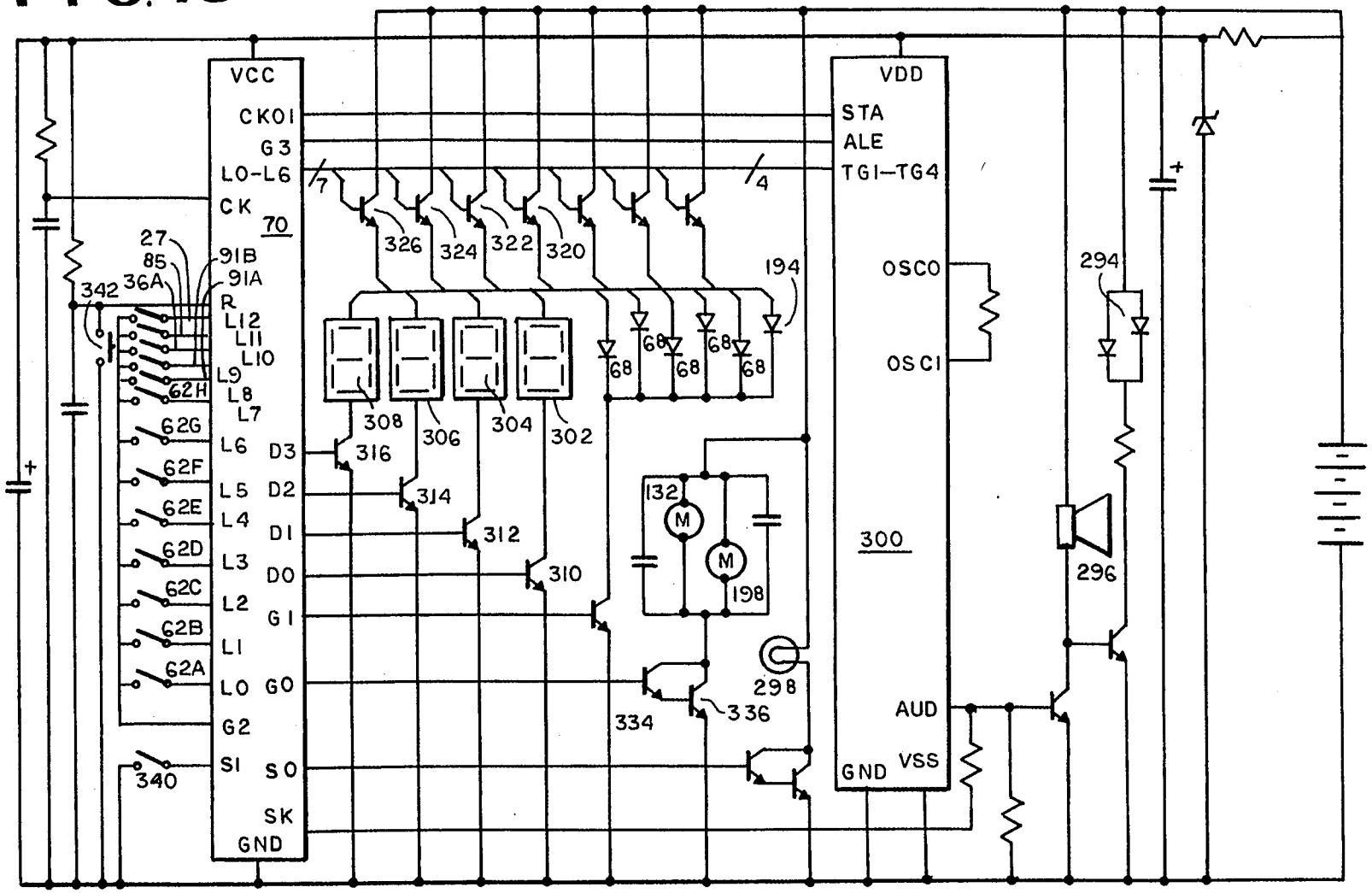
FIG. 15 is an electrical schematic.

Referring now to FIG. 15, is an electrical schematic which generally depicts controller 70, a COP425C 24-pin CPU or the like; dedicated voice IC 300; and associated circuitry. A four digit LED 301 comprised of LEDs 302, 304, 306, and 308 communicate with controller 70 at connecters D0, D1, D2, and D3, through transistors 310, 312, 314, and 316, respectively. Similarly, the LEDs communicate with line(s) 318 which extend from L0–L5 to TG1–TG4 in voice IC 300 and transistors 320, 322, 324, and 326 respectively. LEDs 68 communicate with G1 through transistor 328, and with L0–L5 through transistors 330 and 332. LED 194 in gun 192 illuminates in conjunction with "machine gun sounds" from speaker 296. Drive mechanism motor 132 and figure motor 198 are slaved into G0, through transistors 334 and 336. Dedicated voice IC 300 communicates with controller 70 at TG1–TG4, ALE and STA. ALE receives a low/high pulse from controller 70, such that voice IC 300 accepts addresses for each respective sound. The STA-CK01 line tells controller 70 when voice IC 300 is busy playing respective sounds. Voice IC 300 also contains an internal oscillator OSC-0 and OSC-1, and an audio output AUD which sends a signal through transistor 338 to speaker 296 to communicate digitally stored sounds to the player. Simultaneously, figure "eye" LEDs 294 flicker in a synchronized manner. Electronic sounds are generated by controller 70 every time a ball 50 triggers a scoring signal through the various switches, and are communicated through SK to speaker 296. Target sensor switches 62A–H, flipper sensor switches 91A and 91B, the drive system scoring relay, ball trap switch 85, and ball channel sensor switch 51, are hooked into L0–L12. Power switch 340 is disposed on the exterior of housing 12 as is reset switch 342.

The game is played in a manner similar to known pinball machines. In the preferred embodiment, the general rules are as in the following. The player gets five balls 50 per game. Scoring is effectuated by making contact with rotary spinner 32, active bar bumpers 34, target sensor switches 62, the drive system scoring relay, ball trap 85, and robot target 87 at strategic locations throughout playing field 22. When ball 50 enters channel 35 in housing 12 near the robot, it is held for approximately 2–4 seconds prior to being discharged back onto playing field 22. When a ball 50 enters ball trap 58, scoring switch 85 sends a signal to controller 70 which computes a negative score. FIG. 14 moves in response to user play and periodically slams fist 196 against plunger 104, which raises the angle of incidence of housing 12 relative to support surface 102, triggers a "siren" sound and triples the scoring during the period of time the board is in the elevated position.

Play is initiated by turning on power switch 340, and resetting the game by pressing reset switch 342. FIG. 14 "wakes up," and through speaker 296, says: "Prepare for defeat, human." Pulling knob 94, enables ball 50 to be discharged onto playing field 22; as it passes the target sensor switch 62G in guide 40, sound "A" is generated. Every time flippers 60A and 60B are activated, sound "B" is generated. FIG. 14 "speaks" random phrases after every flipper shot or every time a ball hits a target sensor switch 62, such as:

Nice shot human.

Ouch! That hurt.

Ow! You got me.

After scoring begins, FIG. 14 begins to move around as if it is "reacting" to the players actions. Gun 192 moves around and LED 194 is simultaneously illuminated and accompanied by an explosive sound "C." FIG. 14 also communicates random phrases which may be interrupted by the above phrases if they occur simultaneously:

You will lose this ball.

You cannot defeat me.

Quick! Look behind you!
You're shoe is untied.
Your number is up.
Your reflexes are subhuman.
Don't quit your day job.

Contact with rotary spinners 32 and active bumpers 34 cause random sounds that are simultaneously audible with FIG. 14's statements. When ball 50 enters trap 58, it is held for approximately 2 to 4 seconds prior to ejection. FIG. 14 communicates a series of dedicated sounds accompanied by a background "siren" sound with scoring being reversed. This is the sound of FIG. 14 "hitting" the player. Additionally, FIG. 14 "speaks" the following random phrases:

Ha! Ha! Ha!
Your life will not be spared.
You will never win!

When a ball 50 goes "into" the robot, it is held for approximately 2–4 seconds during which time "eyes" 294 and interior stomach light 298 are illuminated. FIG. 14 "speaks" the following random phrases:

Aagh!
Ooh!
Uh!
Ouch!
Oomph!
Whoa!
Stop! You're killing me!
Stop it!
Overload! Overload!

The scoring also indicates bonus points. When a ball 50 is lost from play, FIG. 14 "says":

Ha! Ha! Ha!
Not bad for an inferior being
Too bad, this is your last battle, take a bonus ball.

When a player attains a certain score, a bonus game or bonus ball is provided. The number of bonus balls remaining may be read off LED 68. It is to be understood that the foregoing is merely exemplary of one embodiment of pinball machine 10, as many different games and themes including such a three dimensional figure may be provided within the scope of the invention.

The present invention has been shown and described in what is considered to be the most practical and preferred embodiment. It is anticipated, however, that departures may be made therefrom and that obvious modifications will occur to person skilled in the art.

We claim:

1. A pinball machine which rests on a support surface, comprising:

a housing having means for translating at least one ball in play throughout a plurality of locations therein, an electronic controller, means for scoring points responsive to play action and means for displaying said scored points, wherein said means for translating, means for scoring, and means for displaying said scored points communicate with said electronic controller;

said means for translating said ball includes path-altering means comprising at least one rotary spinner and at least one bar bumper for changing the path of travel of said ball upon contact during play, said path altering means further comprising drive means for powering said rotary spinner and bar bumper, wherein said drive means includes at least one endless belt for mechanically linking said rotary spinners and bar bumpers to motor means for moving said endless belt.

2. The pinball machine as recited in claim 1, wherein said means for scoring points comprises first means for rotating said spinner operably connected to said drive means;

second means for rotating said first means operably connected to said first means by a torsion spring, said torsion spring having one end fixedly attached to said second means and a free end, said second means having a conductive outer surface on a least a part thereof;

a conductive shaft fixedly attached to said first means, wherein said torsion spring is disposed thereon in conductive association therewith; and means for energizing said shaft when said ball comes into contact with said spinner or said bar bumper, thereby imparting a drag torque which biases said free end of said torsion spring against said conductive outer surface, said means for energizing including a first brush in conductive contact with said conductive outer surface of said second means and a second brush in conductive contact with said shaft, wherein said first and second brushes respectively, communicate with said electronic controller to input a scoring signal.

3. The pinball machine as recited in claim 1, further comprising a three-dimensional figure disposed at one end of, and attached to, said pinball machine.

4. The pinball machine as recited in claim 3, wherein said figure translates at least a part thereof relative to said housing.

5. The pinball machine as recited in claim 4, wherein said figure comprises means for translation of said figure relative to said housing, said figure having at least one arm, said means for translation of said figure comprising a mechanism including a plurality of gears operably connected to a drive motor and periodic drive means for imparting periodic motion to said arm, said mechanism further comprising means for pivoting said figure relative to said housing.

6. The pinball machine as recited in claim 4, wherein said housing includes means for changing the height thereof relative to said support surface in response to movement of said figure.

7. The pinball machine as recited in claim 6, wherein said means for changing the height thereof comprises;

leg means for supporting said housing, said leg means being spring loaded and slidably disposed within said housing and defining a contact area;

a spring loaded plunger extending upward from said housing;

a first link member having first and second ends pivotally attached to said plunger at said first end thereof, wherein said second end pivots against said contact area in said leg means; and a second link member having a first end pivotally attached to said first link member and a second end, said second link member being attached to said first link member at a location intermediate to said first and second ends of said first link member, wherein said second end of said second link member pivots against said contact area in said leg means.

8. A pinball machine, comprising:

a housing having means for translating at least one ball throughout a plurality of locations therein, wherein said means for translating said ball includes path-altering means comprising at least one rotary spinner and bar bumper;

an electronic controller;

scoring means responsive to user play, wherein said scoring means includes first means for rotating said spinner operably connected to said drive means; second means for rotating said first means operably connected to said first means by a torsion spring, said torsion spring having one end fixedly attached to said first means and a free end, said second means having a conductive outer surface on at least a part thereof; a conductive shaft fixedly attached to said first means, having said torsion spring means disposed thereon in conductive association therewith; and means for energizing said shaft when said ball comes into contact with said spinner or bar bumper, thereby imparting a drag torque which biases said free end of said torsion spring against said conductive outer surface, said means for energizing including a first brush in conductive contact with said conductive outer surface of said second means and a second brush in conductive contact with said shaft, wherein said first and second brushes respectively, communicate with said electronic controller;

audio means for communicating sound to a user operably connected to said electronic controller; and illumination means for displaying visual effects operably connected to said electronic controller.

9. A pinball machine which rests on a support surface, comprising:

a housing having means for translating at least one ball in play throughout a plurality of locations therein and means for scoring points responsive to play action, said housing further includes means for changing the height of at least a part thereof relative to said support surface;

means for displaying said scored points operably connected to said means for scoring points; and a three-dimensional figure disposed at one end of and attached to said housing, wherein said figure comprises means for translation thereof relative to said housing, said figure having at least one arm, said means for translation comprising a mechanism including a plurality of gears operably connected to a drive motor and periodic drive means for imparting periodic motion to said arm, said mechanism further comprising means for pivoting said figure relative to said housing, whereby, said means for changing the height of at least a part of said housing are responsive to movement of said figure.

10. A pinball machine, comprising:

a housing having means for translating at least one ball in play throughout a plurality of locations therein;

an electronic controller;

means for scoring points responsive to play action and means for displaying said scored points, wherein said means for translating, means for scoring, and means for displaying said scored points communicate with said electronic controller;

said means for translating said ball includes path-altering means comprising at least one rotary spinner and at least one bar bumper for changing the path of travel of said ball upon contact during play and said path-altering means further comprises drive means for powering said rotary spinner and bar bumper; and said means for scoring points comprises first means for rotating said spinner operably connected to said drive means; second means for rotating said first means operably connected to said first means by a torsion spring, said torsion spring having one end fixedly attached to said second means and a free end, said second means having a conductive outer surface on at least a part thereof; a conductive shaft fixedly attached to said first means, wherein said torsion spring is disposed thereon in conductive association therewith; and means for energizing said shaft when said ball comes into contact with said spinner or said bar bumper, thereby imparting a drag torque which biases said free and end of said torsion spring against said conductive outer surface, said means for energizing including a first brush in conductive contact with said conductive outer surface of said second means and a second brush in conductive contact with said shaft, wherein said first and second brushes respectively, communicate with said electronic controller to input a scoring signal.

11. A pinball machine, comprising:

a housing including a playing field bounded by side walls to form a playing volume, means for translating at least one ball in play throughout a plurality of locations in said housing, means for changing the height of at least a part thereof relative to a support surface, and means for scoring points;

means for displaying said scored points operably connected to said means for scoring points; and an interactive three-dimensional articulated figure attached to said housing at one end thereof and extending substantially above said playing volume, where said means for changing the height of said housing are responsive to movement of said figure.

12. A pinball machine, comprising:

a housing including a playing field bounded by side walls to form a playing volume, means for translating at least one ball in play throughout a plurality of locations in said housing, and means for scoring points;

means for displaying said scored points operably connected to said means for scoring points; and an interactive three-dimensional articulated figure attached to said housing at one end thereof and extending substantially above said playing volume, wherein said figure comprises means for translation thereof relative to said housing, said figure having at least one arm, said means for translation comprising a mechanism including a plurality of gears operably connected to a drive motor and periodic drive means for imparting periodic motion to said arm, said mechanism further comprising means for pivoting said figure relative to said housing.

13. A pinball machine, comprising:

a housing including a playing field bounded by side walls to form a playing volume, means for translating at least one ball in play throughout a plurality of locations in said housing, and means for scoring points;

means for displaying said scored points operably connected to said means for scoring points; and an interactive three-dimensional articulated figure attached to said housing at one end thereof and extending substantially above said playing volume, wherein said playing volume is bounded and enclosed by a transparent covering material and said three-dimensional figure is disposed outside and above said playing volume.

* * * * *